US010471438B2

(12) United States Patent
Chavez

(10) Patent No.: US 10,471,438 B2
(45) Date of Patent: Nov. 12, 2019

(54) AUTOMATIC SHUT-OFF FOOD WASTE DISPOSER SYSTEM

(71) Applicant: Edward Chavez, Anaheim, CA (US)

(72) Inventor: Edward Chavez, Anaheim, CA (US)

( * ) Notice: Subject to any disclaimer, the term of this patent is extended or adjusted under 35 U.S.C. 154(b) by 0 days.

(21) Appl. No.: 16/178,484

(22) Filed: Nov. 1, 2018

(65) Prior Publication Data

US 2019/0210036 A1 Jul. 11, 2019

Related U.S. Application Data

(60) Provisional application No. 62/614,920, filed on Jan. 8, 2018.

(51) Int. Cl.

| | |
|---|---|
| ***B02C 25/00*** | (2006.01) |
| ***B02C 18/12*** | (2006.01) |
| ***B02C 23/36*** | (2006.01) |
| ***B02C 18/00*** | (2006.01) |

(52) U.S. Cl.
CPC ..... *B02C 25/00* (2013.01); *B02C 18/0092* (2013.01); *B02C 18/12* (2013.01); *B02C 23/36* (2013.01)

(58) Field of Classification Search
CPC ..... B02C 25/00; B02C 18/0092
USPC ..... 241/46.013
See application file for complete search history.

(56) References Cited

U.S. PATENT DOCUMENTS 3,071,328 A * 1/1963 Higer ..... B02C 18/0092 241/254
3,300,148 A * 1/1967 Engholdt ..... B02C 18/0084 241/33
3,591,095 A * 7/1971 Di Stefano ..... B02C 18/0092 241/41
4,129,260 A 12/1978 Baker
7,578,460 B2 8/2009 Berger
8,898,828 B2 12/2014 Aykens et al.
9,315,978 B2 4/2016 Aykens et al.
9,752,307 B2 * 9/2017 Bewley, Jr. ..... E03C 1/2665
2004/0251339 A1 12/2004 Strutz
2006/0011759 A1 1/2006 Chavez
2006/0138246 A1 6/2006 Stowe
2009/0249541 A1 10/2009 Aykens et al.
(Continued)

OTHER PUBLICATIONS

US 5,676,391 A, 10/1997, Stiggins et al. (withdrawn)

*Primary Examiner* — Faye Francis
(74) *Attorney, Agent, or Firm* — Jafari Law Group, Inc.; Saul Acherman

(57) ABSTRACT

The invention involves an automatic shut-off waste disposer that may be activated with a control module, which utilizes a programmable automatic shut-off routine. This enables a user to turn on the garbage disposer and walk away without having to turn the disposer off. In exemplary embodiments, activation of the disposer includes actuation of a solenoid valve for injecting a stream of water flow into the dispenser chamber in order to facilitate a proper water flow while the disposer is actively disposing of food waste. In some exemplary embodiments, activation of the disposer may be achieved via a user-activated pneumatic actuator, which may be installed in proximity to the sink to which the disposer is coupled. In some exemplary embodiments, the disposer implements a sensor for automatically shutting of a motor of the disposer upon a predetermined event.

12 Claims, 10 Drawing Sheets

(56) References Cited

U.S. PATENT DOCUMENTS

| | | | | |
|---|---|---|---|---|
| 2012/0151670 | A1 | 6/2012 | Aykens et al. | |
| 2013/0327860 | A1 | 12/2013 | Harooni | |
| 2015/0267386 | A1* | 9/2015 | Bewley, Jr. ..... | E03C 1/2665 241/15 |

* cited by examiner

100

AUTOMATIC SHUT-OFF FOOD WASTE DISPOSER SYSTEM

TECHNICAL FIELD OF THE INVENTION

The present invention relates generally to an automatic shut-off food waste disposer system, and more specifically, to a waste disposer system that may be activated and deactivated with a module that utilizes a programmable automatic shut-off routine.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Food waste disposals, garbage disposals, and food waste disposer units are well-known devices—typically electrically powered and installed under kitchen sinks, between the sink's drain and the trap leading to a building's sewer plumbing—and have been around for some time. In fact, the prior art is busy with different teachings for a wide variety of disposers. However, known devices have several shortcomings, which have not been properly addressed.

For example, one widespread problem is that the motors that drive disposers are prone to overheating. To solve this problem and prevent permanent damage to the motor, known disposers implement circuit boxes or circuitry with breakers and switches that shut off the disposer until it cools down. A user will reach the switch and push a button to allow the disposer to turn on again—ideally once the motor has had a chance to cool down. The problem with this approach is that in time the motor may be damaged from repeated overheating. Accordingly, it is desirable to provide a food waste disposer that properly addresses the issue of overheating.

Another related problem is that an adequate amount of water must be introduced along with the food waste in order for the waste disposer to function properly—that is, if too much waste is shoved down a drain and into a disposer without enough water running, the disposer may not process or adequately shred the waste; this not only causes the sink to clog but may also cause the motor to overheat. While some devices implement complex sensors and auxiliary equipment to control a water flow, such methods make disposers for average home use prohibitively expensive and are thus inadequate for average residential kitchens. Accordingly, it is desirable to provide a food waste disposer that properly addresses the issue of directing an adequate water flow to the disposer chamber.

Yet another problem not adequately addressed by the prior art is the noise that is generated by these devices. The majority of the noise of a food waste disposer comes through the mouth of the disposer. The water from the faucet combined with the food grinding generates a loud undesirable noise, and the prior art does not adequately address this issue. Accordingly, it is desirable to provide a quieter food waste disposer.

Yet another frequent problem not adequately addressed by the prior art is that a user may need to turn on a disposer with wet hands. That is, because disposers are typically switched on by flipping an electric switch, careful users must dry their hands in order to operate safely the electric switch coupled to the food waste disposer. This requires the user to dry their hands and then flip the switch. Because a disposer may be used several times while a user is at the sink, the user could very well need to dry their hands only to get them wet again prior to needing to turn on the disposer again. Accordingly, it is desirable to implement a safer means of activating and deactivating a food waste disposer that obviates a user having to dry their hands prior to each use.

Users themselves may cause their disposer units to malfunction or function with less efficiency as it is typically up to users to activate or turn on these devices for an adequate period of time. For example, it is not uncommon for users to forget to turn the water on while the disposer is shredding waste and thus cause the motor to overheat or to work unnecessarily hard. Conversely, it is not uncommon for users to turn on the water too early or allow too much water to flow into the disposer before activating the unit, thus causing water waste. Similarly, a disposer may be activated for too long a period of time (again causing overheating and eventual damage to the motor) or for too short a period of time, causing waste to be processed improperly, and thus remain in the disposer. Along with the problems mentioned above common to disposers known in the prior art, all these common uses—or misuses of disposers—have not been addressed properly.

Therefore, there exists a previously unappreciated need for a new and improved food waste disposer system that prevents or minimizes overheating, allows enough water flow without being wasteful, severely reduces noise generated by the disposer, provides a safer means of operation and simplifies activation of the disposer in order to circumvent user misuse of the disposer.

It is to these ends that the present invention has been developed.

SUMMARY OF THE INVENTION

To minimize the limitations in the prior art, and to minimize other limitations that will be apparent upon reading and understanding the present specification, the present invention describes an automatic shut-off waste disposer system.

Generally, the invention involves an automatic shut-off waste disposer system that may be activated with a control module. This utilizes a programmable automatic shut-off routine, enabling a user to turn on the garbage disposer and walk away without worrying about having to turn the disposer off. In exemplary embodiments, activation of the disposer includes actuation of a solenoid valve for injecting a stream of water into the disposer chamber in order to facilitate a proper water flow while the disposer is actively disposing of food waste. In exemplary embodiments, activation of the disposer may be achieved via a user-activated pneumatic switch, which may be installed in proximity to the sink to which the disposer is coupled. In some exemplary embodiments, the control module comprises a sensor configured to detect a load value inside a disposer chamber of the disposer. A microprocessor of the control module may receive sensing data indicating the load value and may be configured to discontinue supplying power to a motor of the disposer when a certain low load threshold is detected. In some exemplary embodiments, activation of the disposer may be achieved wirelessly. In some exemplary embodiments, a kit may be provided so that users may convert their disposer unit into a waste disposer system in accordance with the present invention. In other exemplary embodiments, a waste disposer system in accordance with the present invention may be provided as a stand-alone unit fully replacing a prior art disposer.

A food waste disposer kit, in accordance with an exemplary embodiment of the present invention, may comprise an actuator module including a pneumatic actuator; a first enclosure housing a solenoid valve for selectively directing a water flow from a water supply to a disposer chamber of a food waste disposer; and a second enclosure housing a control circuitry for supplying power to the food waste disposer and the solenoid valve, the control circuitry adapted to communicate with the pneumatic actuator and configured to respond to actuation of the pneumatic actuator by: activating the food waste disposer; triggering a programmable time limit; opening the solenoid valve to direct the water flow from the water supply to the disposer chamber of the food waste disposer; and automatically shutting off the food waste disposer and closing the solenoid valve subsequent to an expiration of the programmable time limit.

Another food waste disposer kit, in accordance with an exemplary embodiment of the present invention, may comprise a pneumatic actuator; an enclosure including: a solenoid valve for selectively directing a water flow from a water supply to a disposer chamber of a food waste disposer, and circuitry for supplying power to the food waste disposer and the solenoid valve, the circuitry adapted to communicate with the pneumatic actuator and configured to respond to actuation of the pneumatic actuator by: activating the food waste disposer; triggering a programmable time limit; opening the solenoid valve to direct the water flow from the water supply to the disposer chamber of the food waste disposer; and automatically shutting off the food waste disposer and closing the solenoid valve subsequent to an expiration of the programmable time limit.

A food waste disposer system, in accordance with an exemplary embodiment of the present invention, may comprise an enclosure for housing a shredding mechanism exposed within a disposer chamber; a motor for driving the shredding mechanism; a first compartment situated at a bottom of the enclosure, the first compartment including a solenoid valve for selectively directing a water flow from a water supply to the disposer chamber; a second compartment including a control circuitry for supplying power to the motor and the solenoid valve, the control circuitry in communication with the actuator module and configured to respond to actuation of the actuator module by: activating the food waste disposer; triggering a programmable time limit; opening the solenoid valve to direct the water flow from the water supply to the disposer chamber of the food waste disposer; and automatically shutting off the food waste disposer and closing the solenoid valve subsequent to an expiration of the programmable time limit; and a tube adapted to connect an output of the solenoid valve with a port in fluid communication with the disposer chamber of the food waste disposer.

Another food waste disposer system, in accordance with an exemplary embodiment of the present invention, may comprise a sensor coupled to a motor of the food waste disposer, the sensor configured to detect revolutions per minute (RPM) or torque load data of the motor; and a control circuitry for supplying power to the motor and configured to: activate the motor responsive to a user input; receive the RPM or torque load data from the sensor; and automatically shut off the motor responsive to the RPM or torque load data when the RPM or torque load data is indicative of a programmable RPM value.

Yet another food waste disposer system, in accordance with an exemplary embodiment of the present invention, may comprise a solenoid valve for selectively directing a water flow from a water supply to a disposer chamber of a food waste disposer; a sensor coupled to a motor of the food waste disposer, the sensor configured to detect revolutions per minute (RPM) or torque load data of the motor; and a control circuitry for supplying power to the food waste disposer and the solenoid valve, the control circuitry configured to: activate the food waste disposer responsive to a user input; opening the solenoid valve to direct the water flow from the water supply to the disposer chamber of the food waste disposer; receive the RPM or torque load data from the sensor; automatically shut off the food waste disposer and close the solenoid valve responsive to the RPM or torque load data when the RPM or torque load data is indicative of a programmable RPM value.

It is an objective of the present invention to provide a food waste disposer system that is easy to operate.

It is another objective of the present invention to provide a food waste disposer system that is easy to install.

It is yet another objective of the present invention to provide a food waste disposer system that prevents or minimizes overheating.

It is yet another objective of the present invention to provide a food waste disposer system that allows enough water flow without being wasteful.

It is yet another objective of the present invention to provide a food waste disposer system that simplifies activation of the disposer in order to circumvent user misuse of the disposer.

It is yet another objective of the present invention to provide a food waste disposer system that enables a user to turn on the garbage disposer and walk away without worrying about having to turn the disposer off.

It is yet another objective of the present invention to provide a food waste disposer system kit for converting or retrofitting a common disposer into a waste disposer system in accordance with the present invention.

These advantages and features of the present invention are not meant as limiting objectives, but are described herein with specificity so as to make the present invention understandable to one of ordinary skill in the art.

BRIEF DESCRIPTION OF THE DRAWINGS

In order to enhance their clarity and improve understanding of the various embodiments of the invention, elements in the figures are not necessarily drawn to scale. Furthermore, in order to provide a clear view of the various embodiments of the invention, elements that are known to be common and well understood to those in the industry are not depicted. The drawings that accompany the detailed description can be described briefly as follows.

DETAILED DESCRIPTION OF THE INVENTION

Figure 1:
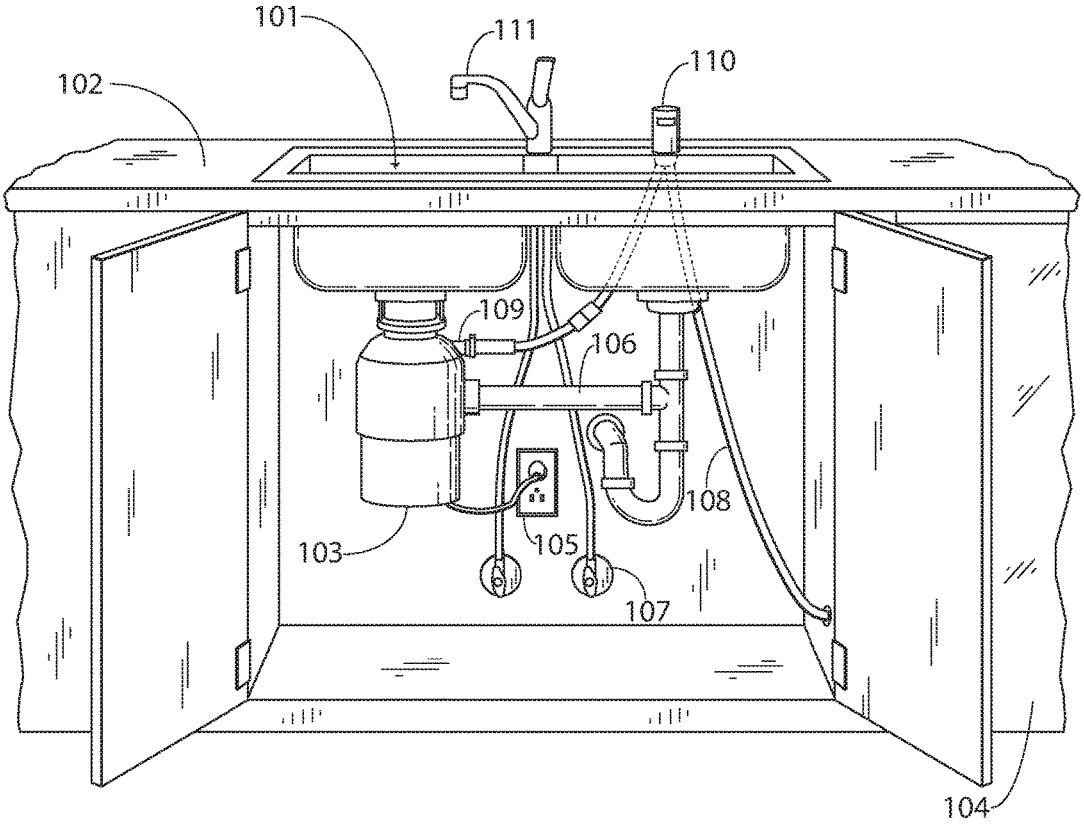
FIG. 1 (PRIOR ART)
FIG. 1 illustrates a perspective view of a sink with a food waste disposer typical of the prior art.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized, and changes may be made without departing from the scope of the invention. Wherever possible, the same reference numbers are used in the drawings and the following description to refer to the same or similar elements.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments, whether these features, elements and/or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, "A, B, and or C" can be replaced with "A, B, and C" written in one sentence and "A, B, or C" written in another sentence. "A, B, and or C" means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms. Furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

Turning now to the figures, FIG. 1 illustrates a perspective view of a sink with a food waste disposer typical of the prior art. More specifically, FIG. 1 depicts prior art system 100, which may recognizably include a sink 101, such as a kitchen sink that sits on a counter 102, below which may be coupled to a food waste disposer (disposer 103). Turning on a faucet 111 of sink 101 typically causes water to flow from a source 107 through faucet 111 into sink 101 and thus to a disposer chamber of disposer 103. Disposer 103 is commonly electrically operated and thus draws power from a power source such as power outlet 105. When disposer is in use, as food waste is introduced via sink 101 into a disposer chamber of disposer 103, a shredding mechanism shreds the food waste into smaller particles so that the particles may be passed through via plumbing 106 to a sewage system. In typical kitchens of today, a dishwasher 104 may also be in fluid communication with dispenser 103, as excess water from dishwasher 104 may be routed via a tube including drainage 108 to dishwasher port 109 of disposer 103, typically injecting any excess water (that is not expelled via air gap device 110) from the dishwasher 104 into the disposer chamber of disposer 103.

To address the many setbacks mentioned above, the present disclosure discusses a number of embodiments, including a kit and a stand-alone disposer, which provide a food waste disposer system that prevents or minimizes overheating, allows enough water flow without being wasteful, simplifies activation of the disposer in order to circumvent user misuse of the disposer, is easier and much safer to operate (no need for wet hands to touch an electrical switch), is easy to install, and enables a user to turn on the garbage disposer and walk away without worrying about having to turn the disposer (or faucet) off.

Figure 2A:
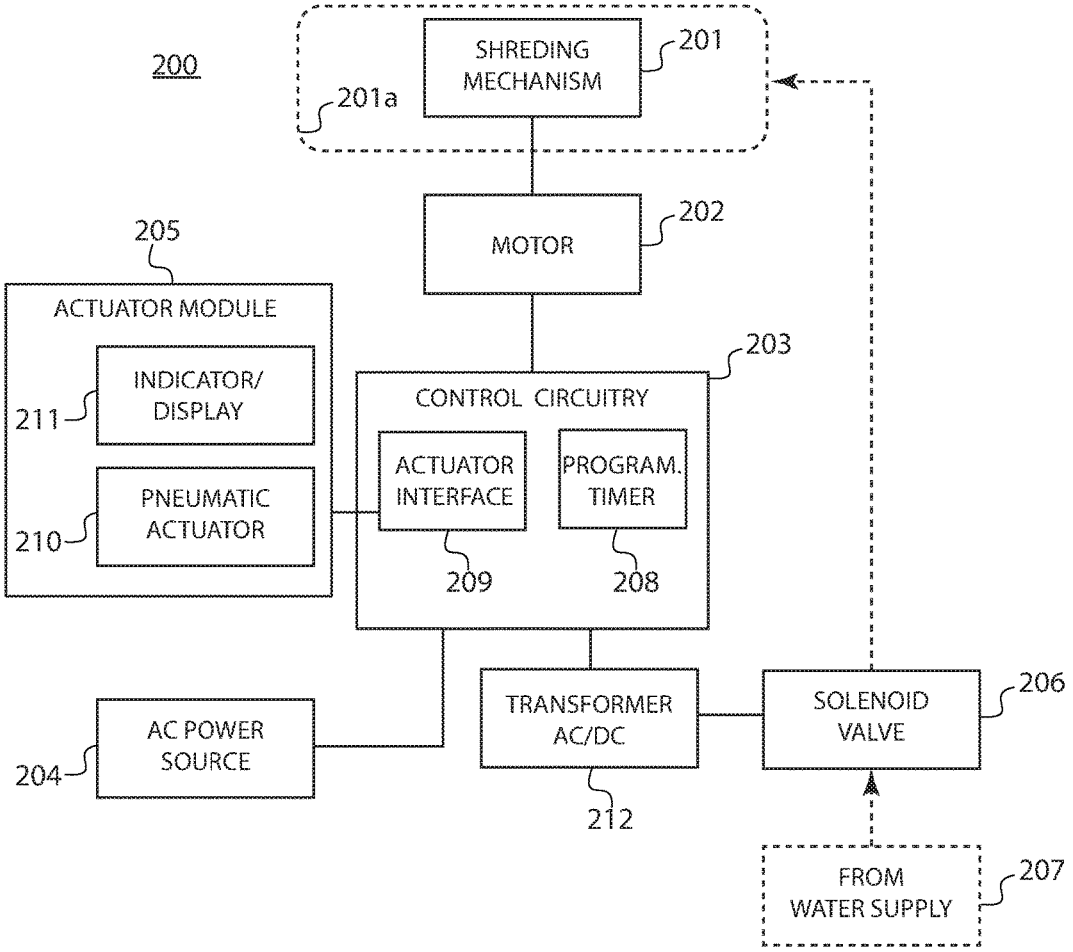
FIG. 2A illustrates a block diagram of a food waste disposer system in accordance with an exemplary embodiment of the present invention.

Turning now to the figures referencing the present invention, FIG. 2A illustrates a block diagram of a food waste disposer system in accordance with an exemplary embodiment. More specifically, FIG. 2A depicts system 200 including several elements of a food waste disposer system in accordance with the present invention such as shredding mechanism 201 (within a disposer chamber 201*a*), motor 202, control circuitry (circuitry 203), power source 204, actuator module 205, solenoid valve 206, and water supply 207. As will be discussed further below, in an exemplary embodiment, most of these elements may be housed within a common enclosure as a stand-alone disposer. In other exemplary embodiments, most of these elements may be housed within one or more enclosures that make up a kit, which enables users to retrofit their food waste disposer (such as disposer 103) into a food waste disposer system in accordance with the present invention.

Shredding mechanism 201 may comprise any typical elements used in disposers for shredding food waste. For example, and without limiting the scope of the present invention, shredding mechanism may comprise a shredding ring or disk, impellers on a flywheel or turntable and or any other suitable components for adequately shredding food waste that enters disposer chamber 201*a* of the food waste disposer. Shredding mechanism is rotatably coupled to and driven by motor 202.

Motor 202 may be a high-torque insulated electric motor with sufficient power to shred common food waste suitable for disposing via a drain of a sink. For example, and without deviating from the scope of the present invention, motor 202 may be an induction or permanent magnet motor that is supplied with power from an AC power source, or a universal motor that may run on either AC power or DC power, or a DC-only motor such as a permanent magnet motor. In some exemplary embodiments, motor 202 is an induction motor suitable for food waste disposer applications. In some exemplary embodiments, motor 202 is a permanent magnet motor suitable for food waste disposer applications. In order to drive motor 202, a control circuitry such as circuitry 203 may be implemented.

Circuitry 203 supplies motor 202 with power from a power supply such as AC power source 204 in order to drive motor 202 and thus engage shredding mechanism 201. Circuitry 203 typically includes a programmable memory 208 with a set of programmable instructions configured to run any number of routines, including an automatic shut-off routine or timer whereby motor 202 is driven for a predetermined time limit and then turned off after the predetermined time limit expires. Implementation of a programmable routine including a programmable time limit is crucial for several reasons. First, this avoids a disposer being activated for too long a period of time. Automating the time necessary for a particular disposer routine or cycle allows energy to be conserved. Second, overheating and resultant damage to the motor can be avoided by driving motor 202 for a proper time period. Conversely, a programmable shut-off ensures that the disposer is not turned on for too short a time, and thus prevents waste from accumulating due to being shredded improperly. Importantly, because a user no longer has to determine how long to keep the disposer running during operation, the life of motor 202 and generally system 200 may be prolonged, and energy and water can be used efficiently and conserved adequately. To activate or trigger the programmable instructions or routines, circuitry 203 is typically adapted to communicate with an actuator or actuator module 205 and may include an interface 209 for communicating with actuator module 205, which receives a user input in order to engage or activate system 200.

Actuator module 205 may be a single component or various components that may range in complexity depending on the attributes of system 200. For example, and without limiting the scope of the present invention, actuator module 205 may include a pneumatic actuator 210, which is coupled to circuitry 203 in order to enable user control of activation of system 200. In one embodiment of the present invention, actuator module 205 comprises pneumatic actuator 210 and no other components. In such embodiment actuator 210 may include a housing with a press button and an air tube that engages or is coupled with actuator interface 209 of circuitry 203. Upon being pressed by a user, actuator 205 will set off a switch instructing circuitry 203 to activate system 200 and start a disposer routine. A disposer routine in accordance with the present invention may typically include: activating the food waste disposer; triggering a programmable time limit; opening solenoid valve 206 to direct the water flow from water supply 207 to disposer chamber 201*a* of the food waste disposer; and automatically shutting off motor 202 of the food waste disposer and closing solenoid valve 206 subsequent to an expiration of the programmable time limit.

In other exemplary embodiments, actuator module 205 may additionally comprise an indicator 211, such as an LED indicator or a display that alerts the user to a variety of information including, for example, a status of system 200. In exemplary embodiments, without limiting the scope of the present invention, a system status indication of system 200 may include an indication of when the system will be completed with a particular disposer routine. For example, indicator 211 may include a display for displaying colors indicating when the disposer is active (red), when it is still working (for example, yellow), and when the routine is complete (for example, green). Other useful information may be presented via display, including but not limited to a status of the motor—whether it is overheated or has an adequate voltage, or any other useful information without limiting the scope of the present invention—depending on the complexity of circuitry 203. In some exemplary embodiments, indicator 211 may include a display to show a countdown so that user sees how long the disposer will run during a particular disposer routine. This may be particularly useful, for example, in embodiments in which circuitry 203 may be programmed with multiple routines of varying lengths. For example, and without limiting the scope of the present invention, in an exemplary embodiment, circuitry 203 may be programmed with a regular 30-second routine initiated when a user presses actuator 210 a single time (i.e. during a regular food waste disposal routine), but a longer routine of 60 seconds when a user presses actuator 210 multiple times in quick succession (i.e. during a cleaning routine). In such embodiment, it may be useful to the user if a countdown is shown, which would indicate the time until the routine is completed as well as the type of routine performed by system 200.

As mentioned above, circuitry 203 is further adapted to communicate with solenoid valve 206. Typically, upon user input via actuator module 205, in conjunction with activation of motor 202, circuitry 203 may be configured to open solenoid valve 206 to direct a water flow from water supply 207 to disposer chamber 201*a* of the food waste disposer. Directing a water flow into the chamber of the food waste disposer is crucial for several reasons. First, the continuous flow of water aids in the shredding of the food waste. Second, dispensing of the food waste into plumbing such as plumbing 106 for disposing of the food waste to the coupled sewage system is facilitated by the flow of water. Moreover, the constant flow of water (particularly cold water) into chamber 201*a* allows motor 202 (typically in proximity to shredding mechanism 201) to remain cool and thus prevent or minimize overheating of motor 202. Importantly, because system 200 ensures that water is directed to disposer chamber 201*a*, a user need not turn on the faucet of the sink to which system 200 is coupled. This prevents user misuse such as turning on the water too early or allowing too much water to flow into the disposer before activating the unit. Accordingly, automatically opening and closing solenoid valve 206 ensures proper operation of disposer system 200 while conserving water.

Solenoid valve 206 may be a typical electromechanically-operated valve. In exemplary embodiments, solenoid valve 206 may be a two-port valve in which the flow may be simply switched on or off, controlled by an electric current through a solenoid coupled to circuitry 203. In other exemplary embodiments, solenoid valve 206 may be a multiple-port valve, in which the outflow is switched between off, and one of two outlet ports for supplying a cold flow and a hot flow of water (for example from a source 107). Such embodiment may be useful in more complex versions of system 200 in which a cleaning routine is programmed into circuitry 203, thus activating motor 202 and opening valve 206 so that hot water is directed to chamber 201*a*. However, in a preferred exemplary embodiment, solenoid valve 206 comprises a two-port valve in which the flow is simply switched on or off; that is, once actuator module or simply pneumatic actuator 210 is activated by user, circuitry 203 may activate the food waste disposer by turning on motor 202, and simultaneously (or closely in conjunction with activation of motor 202) open solenoid valve 206 so that a water flow from water source 207 is directed to disposer chamber 201*a*. This may be achieved with a hose connecting solenoid valve 206 to a port in fluid communication with or leading into chamber 201*a* of the disposer. Preferably, the water source into solenoid valve 206 is from a cold output rather than a hot output, so that the automated system exclusively dispenses cold water into the disposer chamber. Cold water helps congeal food waste such as grease, thus cold water facilitates pushing the congealed grease through the pipes. Moreover, cold water helps prevent pipes from clogging due to grease being liquified by hot water and building up within the pipes over time. By exclusively providing cold water to the disposer chamber, user will be prevented from inadvertently using hot water from the faucet, since the system is automated. Accordingly, in such embodiment, cold water will flow from water source 207 and directly to disposer chamber 201*a*. In one exemplary embodiment, the port may be a dishwasher port such as dishwasher port 109. In another exemplary embodiment, the port may be a port situated on a sink flange that leads into chamber 201*a*. In yet other embodiments, the port may be any other type of inlet, opening or port that fluidly connects solenoid valve 206 with chamber 201*a*. Upon an expiration of the programmable time limit triggered during or after activation of motor 202, circuitry 203 may automatically shut off the food waste disposer by deactivating or cutting off a power supply to motor 202, and subsequently (simultaneously or closely in conjunction with deactivation of motor 202) close solenoid valve 206 by deactivating or cutting off a power supply to solenoid valve 206. Because system 200 is automated once activated by a user, there is no need for a user to use the faucet while system 200 is in use. This allows the user to put a sink drain stopper in place during operation, which greatly reduces noise generated from within the disposer chamber.

In exemplary embodiments, circuitry 203 may be configured to draw AC power from AC power source 204 and supply DC power to solenoid valve 206. This may be achieved in any number of ways, including implementation of a transformer that is part of circuitry 203 or by connecting a separate transformer 212 that can be coupled to both circuitry 203 and solenoid valve 206; the latter enabling an easy solution for a kit in which several components may be offered to a user for retrofitting a food waste disposer into a disposer in accordance with the present invention.

As mentioned above, in exemplary embodiments, circuitry 203 may be configured with different programmable routines. For example, and without limiting the scope of the present invention, shutting off the food waste disposer and closing the solenoid valve may occur simultaneously. Alternatively, shutting off the food waste disposer and closing the solenoid valve may occur within a programmable delay so that one occurs after the other. Similarly, activating motor 202 and opening solenoid valve 206 may be programmed so that the two actions are simultaneous or within a programmable delay so that one occurs after the other.

In exemplary embodiments, these routines may be pre-programmed into the memory of circuitry 203 and may not be re-programmed by an end-user such as a typical consumer. In other exemplary embodiments, circuitry 203 may be more complex and allow for end-user programming. For example, in one embodiment, circuitry 203 may include a transceiver for communicating with an external device, such as a mobile phone, and can be programmed via a mobile application accessible to an end-user, including a technician or consumer.

Figure 2B:
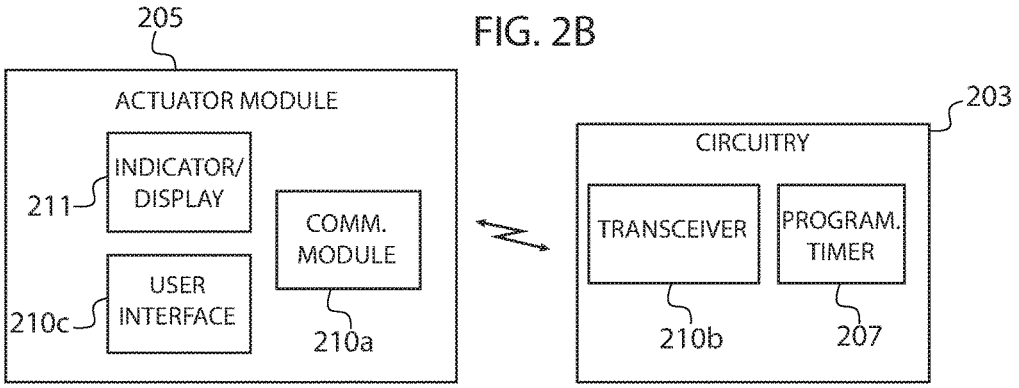
FIG. 2B illustrates a block diagram of another food waste disposer system in accordance with an exemplary embodiment of the present invention.

Turning now to the next figure, FIG. 2B illustrates a block diagram of another food waste disposer system in accordance with an exemplary embodiment of the present invention. More specifically, this figure shows an alternative embodiment of system 200, in which, rather than employing a pneumatic actuator 210, actuator module 205 may employ communication module 210*a* that communicates with circuitry 203 via a transceiver 210*b*. In an exemplary embodiment, actuator module 210*a* may be placed anywhere within range of transceiver 210*b* and via a user interface 210*c*, a user may enter a user input that sends a command via communication module 210*a* to circuitry 203 for activating system 200. Without deviating from the scope of the present invention, communication module 210*a* may employ any number of technologies including Bluetooth™, near-field communication, Wi-Fi™, or any other wireless communication protocols known in the art.

Figure 3:
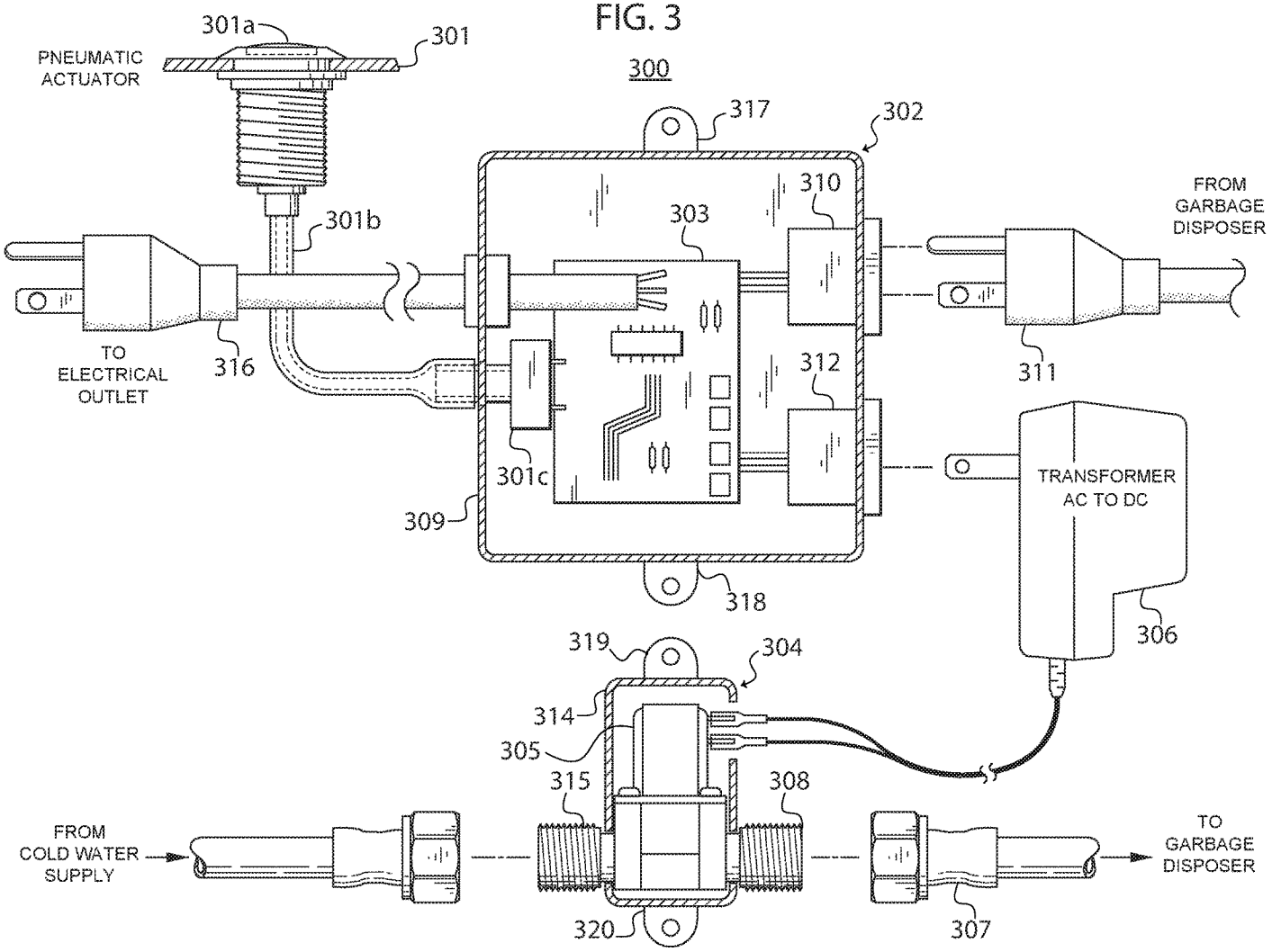
FIG. 3 illustrates an exemplary kit for retrofitting a typical food waste disposer into a food waste disposer system in accordance with an exemplary embodiment of the present invention.

Turning next to FIG. 3, an exemplary kit for retrofitting a typical food waste disposer into a food waste disposer system in accordance with an exemplary embodiment of the present invention is illustrated. More specifically, kit 300 is an exemplary food waste disposer kit including pneumatic actuator 301, an enclosure 302 housing control circuitry 303, an enclosure 304 housing solenoid valve 305, transformer 306, and at least one tubing or hose 307 for fluidly connecting an output 308 of solenoid valve 305 to a port (such as dishwasher port 109 or a sink flange port) of the food waste disposer or any other port that may be implemented for fluidly connecting output 308 to the chamber of the food waste disposer.

Pneumatic actuator 301 may be a basic pneumatic actuator without any displays or additional components. Pneumatic actuator 301 typically includes a button 301*a* and a tube 301*b* that communicates compressed air to a switch or interface 301*c* to circuitry 303 in order to activate the system controlled by the components of kit 300 upon a user pressing button 301*a*. An advantage of implementing pneumatic actuator 301 is that unlike conventional electric switches that may be used to activate a disposer, pneumatic actuator 301 may be conveniently installed horizontally or on a surface in proximity to the sink, rather than wall-mounted.

Figure 5A:
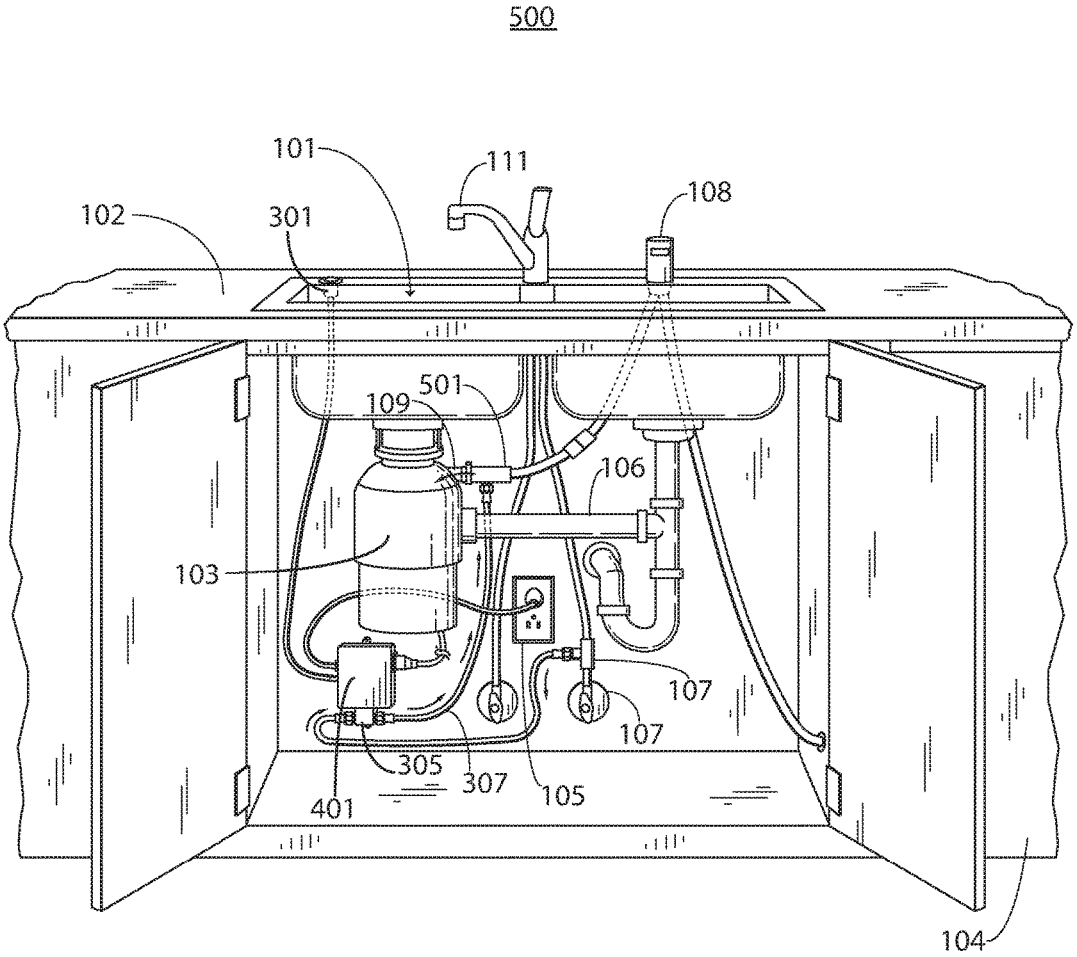
FIG. 5(*a*)-5(*b*) illustrate a perspective view of a sink with a food waste disposer system in accordance with exemplary embodiments of the present invention.
Figure 5B:
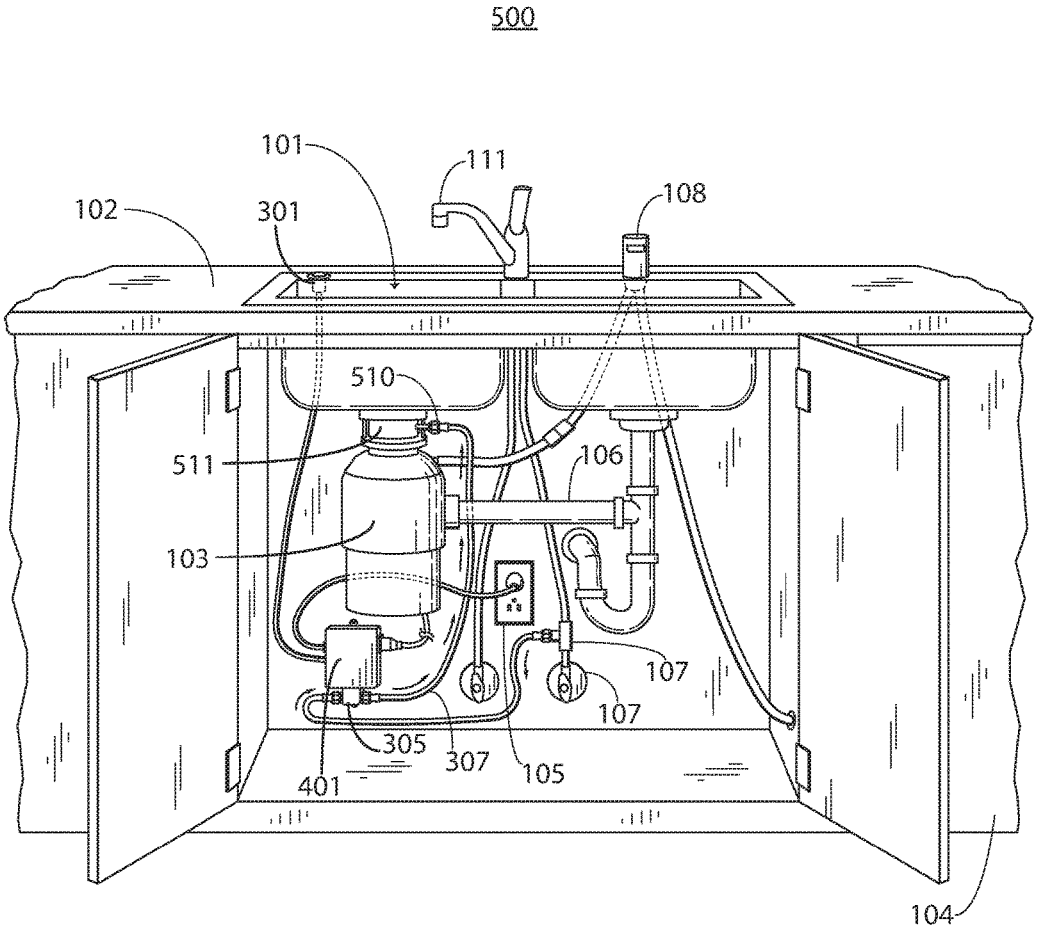

That is, pneumatic actuator 301 may be safely installed on a rim of the sink itself so that the actuator is positioned horizontally (which facilitates is use) rather than vertically as is usually the case with wall-mounted electric switches commonly used to start prior art devices such as the dispenser in system 100. Of course, a typical wall-mounted type of electric switch would be unsafe in too close proximity to the sink; an example of an installed pneumatic actuator 301 (installed horizontally in close proximity to a sink) is depicted in FIG. 5, and is ideal, for example, for kitchen islands.

Enclosure 302 may be generally constructed of a lightweight, yet sturdy material such as plastic, although other suitable materials may be implemented without deviating from the scope of the present invention. Moreover, enclosure 302 is typically tightly sealed and may include one or more compartments (not necessarily shown here) in order to secure circuitry 303 and any other components therein in a manner that prevents undesired exposure to elements including water that may spill from a sink or food waste disposer. Enclosure 302 may include any number of shapes, and in exemplary embodiments is typically a rectangular structure with a rectangular perimeter that encapsulates the contents therein. In the shown embodiment, enclosure 302 is a substantially rectangular structure with an exterior wall 309. To facilitate installation, in exemplary embodiments of enclosure 302, a power outlet 310 may be implemented for receiving a power plug 311 directly from the food waste dispenser such as food waste dispenser 103. In such embodiments, power outlet 310 may be situated on a perimetrical edge of exterior wall 309 of enclosure 302. Similarly, a power outlet 312 may be implemented for receiving a power input or plug directly from solenoid valve 305; in an exemplary embodiment such as the one depicted in FIG. 3, solenoid valve 305 may include transformer 306 that is separate from or external to circuitry 303. As such, power outlet 312 may be situated on the perimetrical edge of exterior wall 309 of enclosure 302 in order to facilitate installation of kit 300.

Control circuitry 303 is typically adapted to communicate with pneumatic actuator 301 via a switch or interface 301*c* that may be situated on the perimetrical edge of exterior wall 309 in order to facilitate installation. Additionally, circuitry 303 generally includes power outputs for supplying power to the food waste disposer and the solenoid valve, as well as power inputs for drawing power from a power source. In the shown embodiment, for the sake of easy installation, power plugs 310 and 312 are on an opposite side of external wall 309 of enclosure 302, although other orientations may be possible without deviating from the scope of the present invention. Similarly, to facilitate installation, a power cord 316 may extend from enclosure 302 in order to connect circuitry 303 to a power source such as a typical household electrical outlet. As mentioned above, circuitry 303 in accordance with the present invention includes a programmable memory with a set of programmable instructions such that circuitry 303 may be configured to respond to actuation of pneumatic actuator 301 by: activating the food waste disposer (by supplying power to the food waste disposer's motor); triggering a programmable time limit; simultaneously or in conjunction with triggering the programmable time limit, opening solenoid valve 305 (by supplying power to solenoid valve 305) to direct water flow from the water supply via hose 307 to a disposer chamber of the food waste disposer; and subsequently to an expiration of the programmable time limit, automatically shutting off the food waste disposer (by turning off the power supply to the motor of the food waste disposer) and closing solenoid valve 305 (by turning off the power supply to solenoid valve 305).

Enclosure 304, like enclosure 302, may be generally constructed of a lightweight, yet sturdy material such as plastic, although other suitable materials may be implemented without deviating from the scope of the present invention. Moreover, enclosure 304 is typically tightly sealed and may include one or more compartments (for example to achieve watertight separation of the valve and solenoid of the solenoid valve 305) in order to secure solenoid valve 305 in a manner that prevents undesired exposure to elements, including water that may spill from a sink or food waste disposer. Enclosure 304 may include any number of shapes, and in exemplary embodiments is typically a rectangular structure with a rectangular perimeter that encapsulates the contents therein. In the shown embodiment, enclosure 304 is a substantially rectangular structure with an exterior wall 314. Enclosure 304 typically includes an input port or opening for exposing an input port 315 of solenoid valve 305, and an output port or opening for exposing output port 308 of solenoid valve 305.

As can be appreciated from FIG. 3, in this exemplary embodiment, enclosure 302 is separate and distinct from enclosure 304, and each of these enclosures is separate and distinct from an enclosure of the food waste disposer (not shown) to which the components of kit 300 may be coupled. An advantage of providing kit 300 to consumers is that a consumer with a regular disposer 103 may easily install or hook up the several depicted components to the existing food waste disposer with ease. For example, and without deviating from the scope of the present invention, installation of kit 300 may simply require (i) affixing the enclosures 302 and 304 against a wall or support structure using mounting supports 317, 318, 319 and 320; (ii) connecting power plug 311 of the food waste disposer to power outlet 310 of the control unit (in this case enclosure 302); (iii) connecting transformer to solenoid valve 305 and also to power outlet 312 of the control unit; (iv) connecting hose 307 to solenoid valve 305's output port 308 and to either a dishwasher port of the food waste disposer (i.e. dishwasher port 109) or to any other type of inlet, opening or port that fluidly connects solenoid valve 305 with a chamber (such as chamber 201*a*) of the food waste disposer; and (v) plugging the control unit to an electrical outlet (such as power outlet 105). In this manner, a user may cost-effectively retrofit their old system to an improved system in accordance with the present invention.

Figure 4:
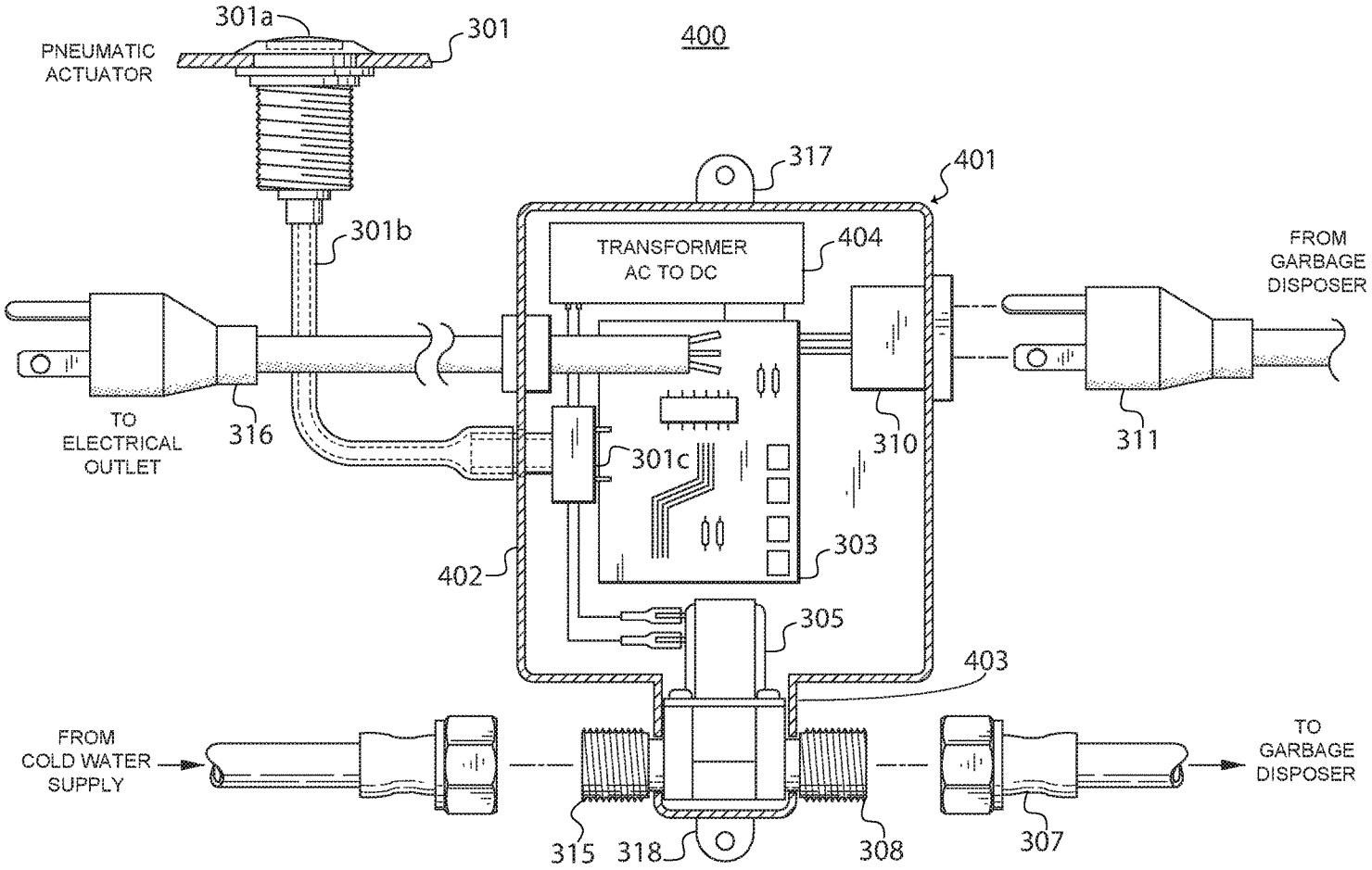
FIG. 4 illustrates another exemplary kit for retrofitting a typical food waste disposer into a food waste disposer system in accordance with an exemplary embodiment of the present invention.

Turning now to the next figure, FIG. 4 illustrates another exemplary kit for retrofitting a typical food waste disposer into a food waste disposer system in accordance with an exemplary embodiment of the present invention. More specifically, kit 400 is an exemplary food waste disposer kit including the same or similar components as those of kit 300, except that kit 400 employs a single enclosure for storing many of the components therein. Accordingly, for the sake of brevity of the disclosure, those similar components will not be discussed at length. Rather than employing two separate enclosures 302 and 304, kit 400 employs a single enclosure 401 for housing circuitry 303 and solenoid valve 305. Moreover, in exemplary embodiments, enclosure 401 may further house transformer 404, which is internally coupled to circuitry 303 and solenoid valve 305.

Enclosure 401, like enclosures 302 and 304, may be generally constructed of a lightweight, yet sturdy material such as plastic, although other suitable materials may be implemented without deviating from the scope of the present invention. Moreover, enclosure 401 is typically tightly sealed and may include one or more compartments (for example to achieve watertight security of circuitry 303 and separate the valve and solenoid of the solenoid valve 305) in order to secure the components in a manner that prevents undesired exposure to elements including water that may spill from a sink or food waste disposer. Enclosure 401 may include any number of shapes, and in exemplary embodiments is typically a rectangular structure with a rectangular perimeter that encapsulates the contents therein. In the shown embodiment, enclosure 304 is a substantially rectangular structure with an exterior wall 402. Additionally, in exemplary embodiments, such as depicted in FIG. 4, enclosure 401 may include a protrusion 403 at a bottom portion of the enclosure to compactly expose the inlet port 315 and outlet port 308 of solenoid valve 305.

As with kit 300, kit 400 may be installed easily, and perhaps more quickly than kit 300, since only a single enclosure 401 is employed. For example, and without deviating from the scope of the present invention, installation of kit 400 may simply require (i) affixing enclosure 400 against a wall or support structure using mounting supports 317 and 318; (ii) connecting power plug 311 of the food waste disposer to power outlet 310 of the control unit (in this case enclosure 401); (iii) connecting hose 307 to solenoid valve 305's output port 308 and to either a port of the food waste disposer (i.e. such as dishwasher port 109 or a sink flange port) or to any other type of inlet, opening or port that fluidly connects solenoid valve 305 with a chamber (such as chamber 201*a*) of the food waste disposer; and (iv) plugging the control unit to an electrical outlet (such as power outlet 105). In this manner, a user may cost-effectively retrofit their old system to an improved system in accordance with the present invention.

By way of example, FIG. 5(*a*) and FIG. 5(*b*) depict different embodiments of system 500, which comprises disposer 103 retrofitted with kit 400 in accordance with the present invention.

In the exemplary embodiment of FIG. 5(*a*), system 500 may implement a dishwasher port connector 501 that facilitates a connection of hose 307 (the output from solenoid valve 305) into a dishwasher port 109 that may be existent on food waste disposer 103. Accordingly, and without limiting the scope of the present invention, kits 300 or 400 may include the elements or components described with reference to FIG. 3 or 4 and in addition include dishwasher port connector 501. In exemplary embodiments, dishwasher port connector 501 may further include a check-valve to prevent any water from being inadvertently directed back towards drainage 108.

In the exemplary embodiment of FIG. 5(*b*), rather than implementing dishwasher port connector 501, system 500 may implement a sink flange port connector 510 that facilitates a connection of hose 307 (the output from solenoid valve 305) into sink flange 511, which includes sink flange port 510. Accordingly, and without limiting the scope of the present invention, kits 300 or 400 may include the elements or components described with reference to FIG. 3 or 4 and in addition include sink flange 511, which includes sink flange port 510.

Figure 6:
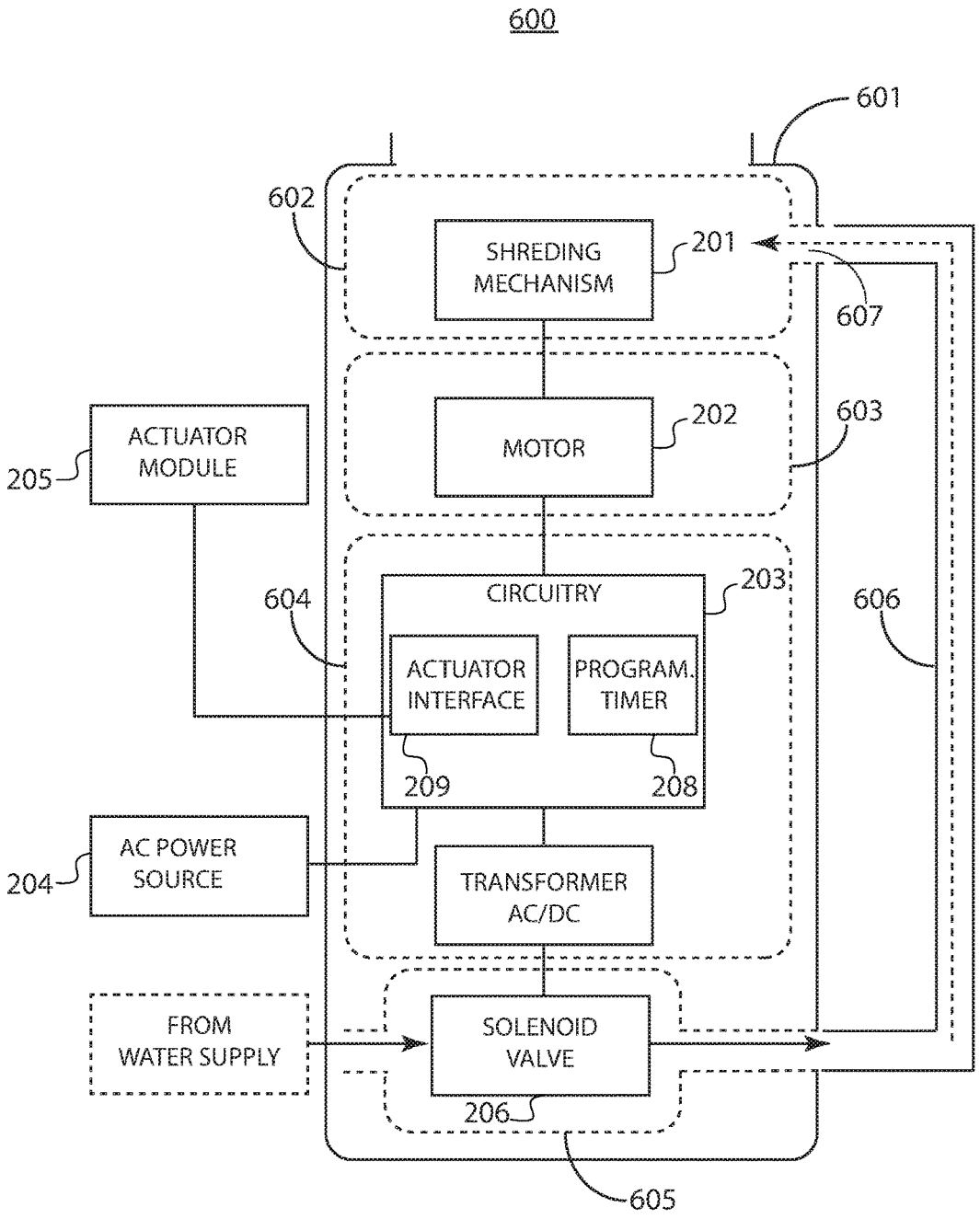
FIG. 6 illustrates a block diagram of a waste disposal system in accordance with an exemplary embodiment of the present invention.

Turning now to FIG. 6, a block diagram of a waste disposal system in accordance with an exemplary embodiment of the present invention is illustrated. More specifically, FIG. 6 depicts a block diagram of food waste disposer system 600, featuring a stand-alone disposer which includes a majority of the components in accordance with the invention within a single enclosure 601. This enclosure houses shredding mechanism 201, motor 202, circuitry 203 (including programmable memory 208, actuator interface 209 and transformer 212), and solenoid valve, 206 typically within several compartments. For example, and without limiting the scope of the present invention, the components may be distributed within each of the plurality of compartments as follows:

The shredding mechanism may be in a top compartment or disposer chamber 602 of enclosure 601, which includes a port 607 (i.e. a dishwasher port or any other type of inlet, opening or port such as a sink flange port that fluidly connects solenoid valve 206 with disposer chamber 602). Motor 202, which is rotatably coupled to shredding mechanism 201, may be housed adjacently thereto in compartment 603. Circuitry 203 and transformer 212 may be housed within compartment 604, and solenoid valve 206 may be housed in a separate compartment situated at the bottom of enclosure 601. To direct a water flow from a water source to disposer chamber 602, a hose 606 may be typically employed as discussed above.

Figure 7:
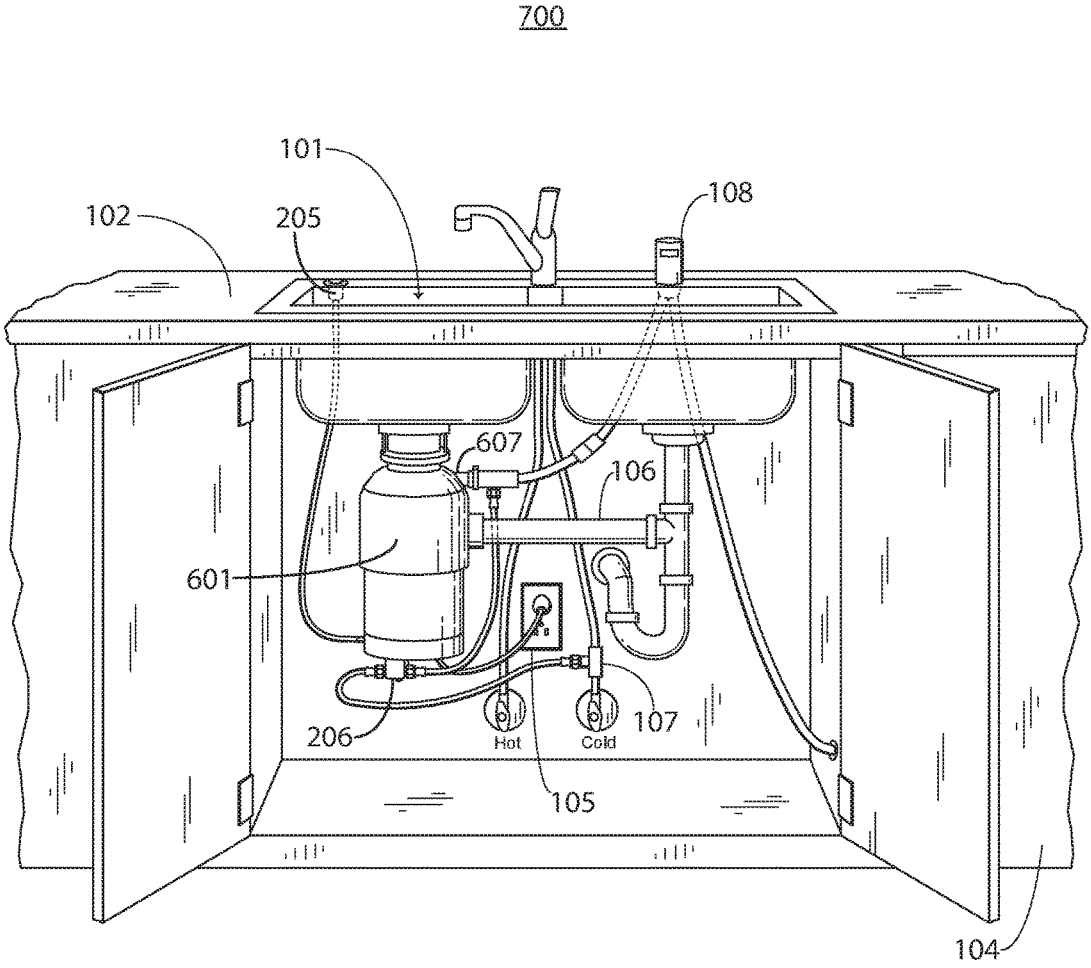
FIG. 7 illustrates a perspective view of a sink with a food waste disposer system in accordance with an exemplary embodiment of the present invention.

The next figure, FIG. 7, by way of a non-limiting example, depicts system 700, which comprises a food waste disposer implementing an enclosure 601, whereby the disposer is a stand-alone disposer and most components, with the exception of the hose and actuator module, are housed within enclosure 601.

Figure 8:
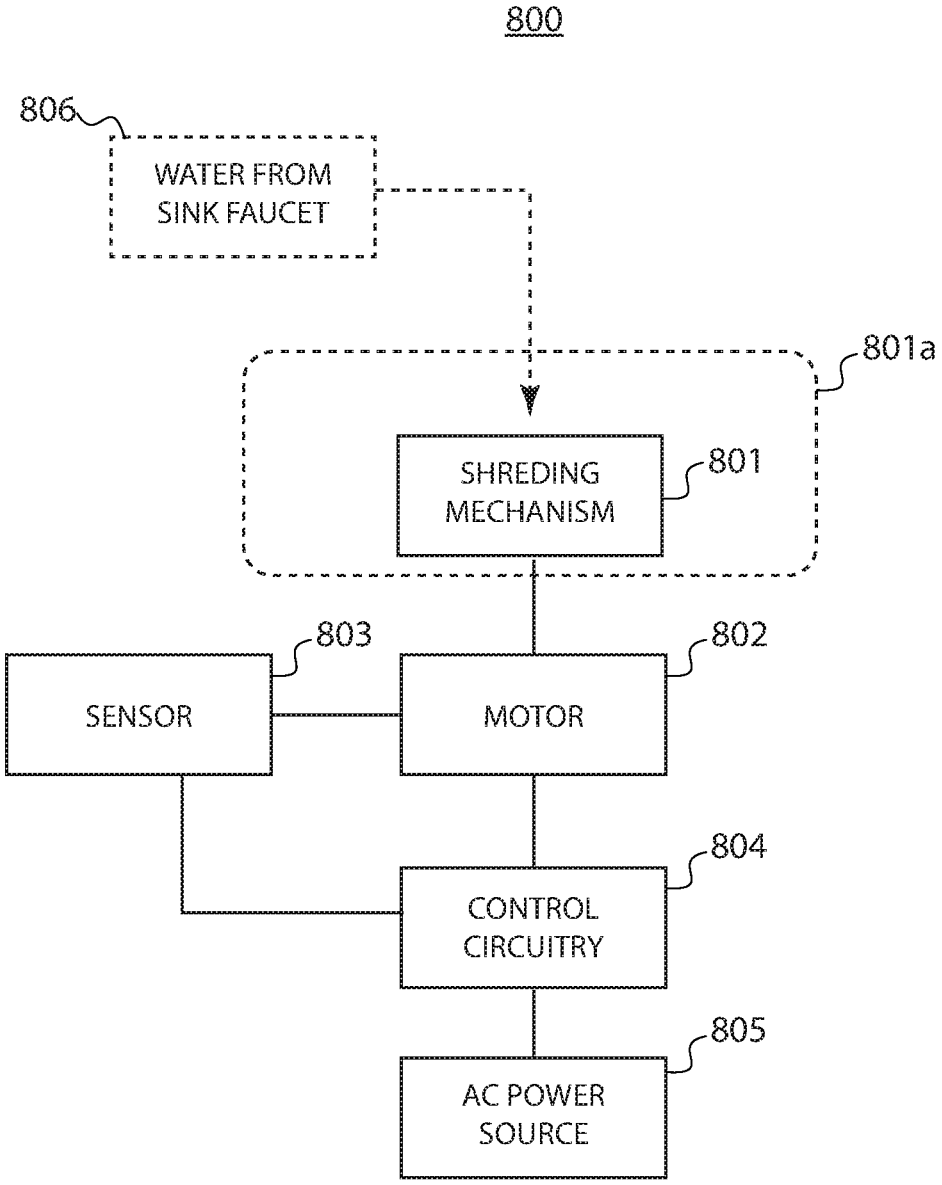
FIG. 8 illustrates a block diagram of a waste disposal system in accordance with an exemplary embodiment of the present invention.

Turning now to the next figure, FIG. 8 illustrates a block diagram of yet another exemplary embodiment of the present invention wherein a food waste disposer is configured for automatically shutting off. More specifically, FIG. 8 depicts system 800 including several elements of a food waste disposer system in accordance with the present invention such as shredding mechanism 801 (within a disposer chamber 801*a*), motor 802, a sensor 803 coupled to motor 802 and in communication with a control circuitry (circuitry 804), and a power source 805. Typically, water may be received into the disposer chamber 801*a* from a typical sink faucet 806. As will be discussed further below, in an exemplary embodiment, most of these elements may be housed within a common enclosure as a stand-alone disposer.

Shredding mechanism 801 may comprise any typical elements used in disposers for shredding food waste, as discussed with other embodiments. For example, and without limiting the scope of the present invention, shredding mechanism may comprise a shredding ring or disk, impellers on a flywheel or turntable and or any other suitable components for adequately shredding food waste that enters disposer chamber 801*a* of the food waste disposer. Shredding mechanism is rotatably coupled to and driven by motor 802.

Motor 802 may be a high-torque insulated electric motor with sufficient power to shred common food waste suitable for disposing via a drain of a sink. For example, and without deviating from the scope of the present invention, motor 802 may be an induction or permanent magnet motor suitable for food waste disposer applications. In order to drive motor 802, a control circuitry such as circuitry 804 may be implemented.

Sensor 803 may be coupled to motor 802 and configured to detect revolutions per minute (RPM) or torque load data of the motor. Control circuitry 804 supplies motor 802 with power from a power supply such as AC power source 805 in order to drive motor 802 and thus engage shredding mechanism 801. Control circuitry 804 typically includes a programmable memory with a set of programmable instructions configured to run any number of routines, including an automatic shut-off routine whereby motor 802 is driven until a threshold RPM or torque load value is detected by the control circuitry per the RPM or torque load data supplied to the control circuitry via sensor 803 coupled to motor 802. In exemplary embodiments, control circuitry 804 is configured to automatically shut off the food waste disposer responsive to the RPM or torque load data when the RPM or torque load data is indicative of a programmable RPM or torque load value.

For example, and without limiting the scope of the present invention, low RPM or a high torque load of motor 802 may be indicative of a disposer chamber 801*a* that is filled with a load including food waste, while high RPM or a low torque load of motor 802 may be indicative of a disposer chamber 801*a* that is empty or merely filled with a load including water only (i.e. because sink faucet 806 is running). As such, during typical operation of system 800, control circuitry 804 may be programmed to automatically shut off power to motor 802 (and thereby to the food waste disposer) upon receiving RPM or torque load data that is indicative of a high RPM or a low torque load value. This threshold RPM or torque load value may be pre-programmed by the manufacturer or installer, or may be programmable by a user without deviating from the scope of the present invention.

Accordingly, in some exemplary embodiments of the present invention, a food waste disposer system configured for automatic shut-off may comprise a sensor 803 coupled to a motor 802 of the food waste disposer, wherein the sensor 803 is configured to detect revolutions per minute (RPM) or torque load data of the motor 802; and a control circuitry 804 for supplying power to the motor 802 and configured to: activate the motor 802 responsive to a user input; receive the RPM or torque load data from the sensor 803; and automatically shut off the motor 802 responsive to the RPM or torque load data when the RPM or torque load data is indicative of a programmable RPM or torque load value.

Figure 9:
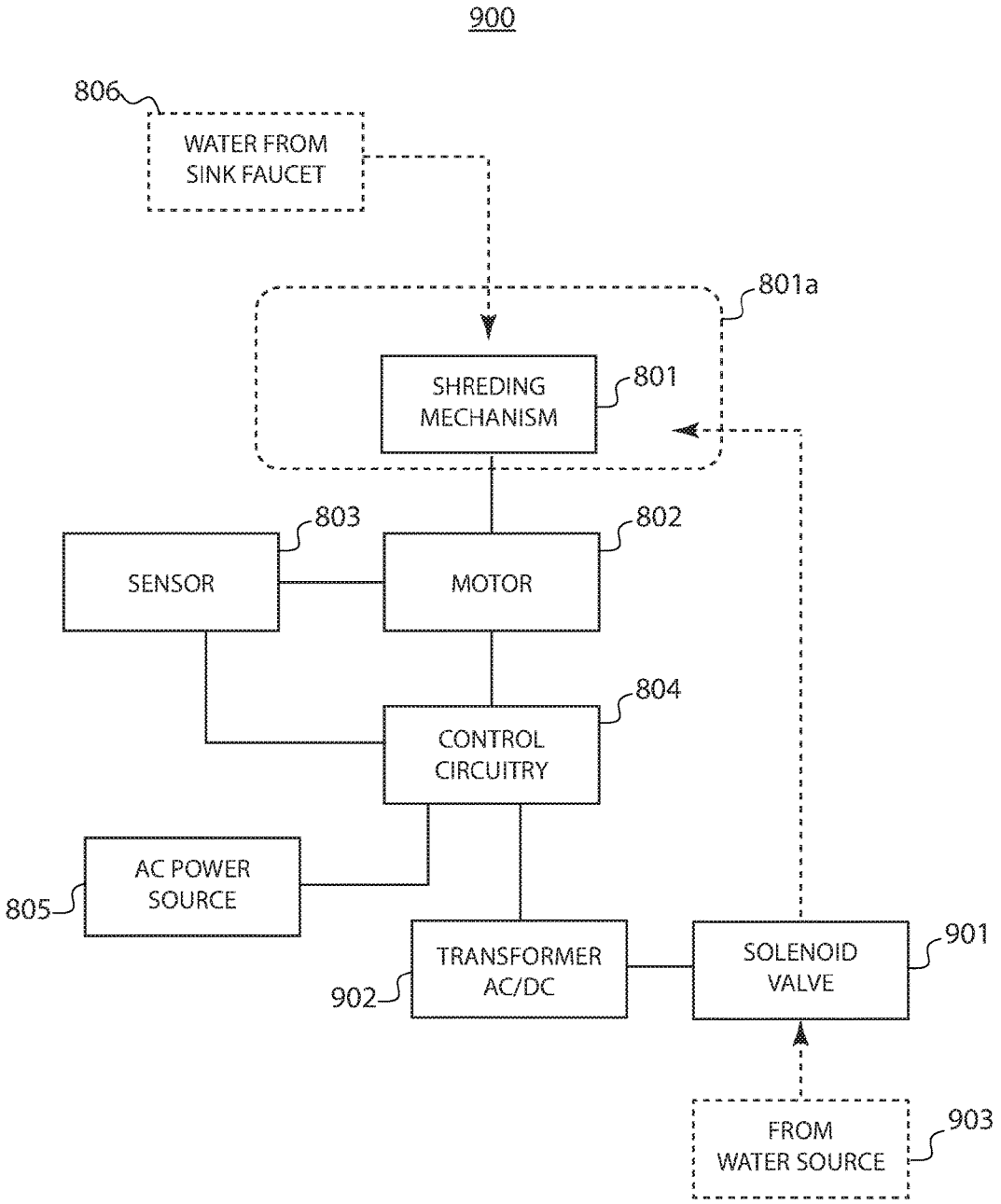
FIG. 9 illustrates a block diagram of a waste disposal system in accordance with an exemplary embodiment of the present invention.

Turning to the last figure, FIG. 9 illustrates a block diagram of yet another exemplary embodiment of the present invention wherein a food waste disposer is configured for automatically shutting off. Similar to system 800, FIG. 9 depicts system 900, which also includes a shredding mechanism 801 (within a disposer chamber 801*a*), motor 802, a sensor 803 coupled to motor 802 and in communication with a control circuitry (circuitry 804), and a power source 805, but further includes solenoid valve 901 powered via transformer 902 and configured to receive water from a water source 903 (as with the solenoid valve's discussed with reference to previous embodiments).

As mentioned above, control circuitry 804 is further adapted to communicate with solenoid valve 901. Typically, upon user input via a switch such as an on-switch coupled to circuitry 804, in conjunction with activation of motor 802, control circuitry 804 may be configured to open solenoid valve 901 to direct a water flow from water supply 903 to disposer chamber 801*a* of the food waste disposer. Directing a water flow into the chamber of the food waste disposer is crucial for several reasons. First, the continuous flow of water aids in the shredding of the food waste. Second, dispensing of the food waste into plumbing such as plumbing 106 for disposing of the food waste to the coupled sewage system is facilitated by the flow of water. Moreover, the constant flow of water (particularly cold water) into chamber 801*a* allows motor 802 (typically in proximity to shredding mechanism 801) to remain cool and thus prevents or minimizes overheating of motor 802. Importantly, because system 900 ensures that water is directed to disposer chamber 801*a*, a user need not turn on the faucet of the sink to which system 900 is coupled. This prevents user misuse such as turning on the water too early or allowing too much water to flow into the disposer before activating the unit. Accordingly, automatically opening and closing solenoid valve 901 ensures proper operation of disposer system 900 while conserving water.

Solenoid valve 901 may be a typical electromechanically-operated valve. In exemplary embodiments, solenoid valve 901 may be a two-port valve in which the flow may be simply switched on or off, controlled by an electric current through a solenoid coupled to circuitry 804. In other exemplary embodiments, solenoid valve 901 may be a multiple-port valve, in which the outflow is switched between off, and one of two outlet ports for supplying a cold flow and a hot flow of water (for example form a source 107). Such embodiment may be useful in more complex versions of system 900 in which a cleaning routine is programmed into circuitry, 804 thus activating motor 802 and opening valve 901 so that hot water is directed to chamber 801*a*. However, in a preferred exemplary embodiment, solenoid valve 901 comprises a two-port valve in which the flow is simply switched on or off; that is, once an on-switch of control circuitry 804 is activated by a user input, control circuitry 804 may activate the food waste disposer by turning on motor 802, and simultaneously (or closely in conjunction with activation of motor 802) opening solenoid valve 901 so that a water flow from water source 903 is directed to disposer chamber 801*a*. This may be achieved as with the embodiment of system 200 discussed above with reference to FIG. 2A. Accordingly, in exemplary embodiments, cold water will flow from water source 903 and directed to disposer chamber 801*a*.

As with the embodiment comprising system 800, control circuitry may be configured to shut off the food waste disposer responsive to the RPM or torque load data when the RPM or torque load data is indicative of a programmable RPM or torque load value. That is, control circuitry 804 may be programmed to shut off power to motor 802 automatically (and thereby to the food waste disposer) upon receiving RPM or torque load data that is indicative of a high RPM or torque load value. Moreover, upon detecting the threshold RPM or torque load value of motor 802, control circuitry 804 may automatically and subsequently (i.e. simultaneously or closely in conjunction with deactivation of motor 802) close solenoid valve 901 by deactivating or cutting off a power supply to solenoid valve 901. Because system 900 is automated, once it is activated or turned on by a user, there is no need for a user to use the faucet while system 900 is in use. This allows the user to put a sink drain stopper in place during operation, which greatly reduces noise generated from within the disposer chamber.

In exemplary embodiments, control circuitry 804 may be configured to draw AC power from AC power source 805 and supply DC power to solenoid valve 901. This may be achieved in any number of ways, including implementation of a transformer that is part of circuitry 804 or by connecting a separate transformer 902 that can be coupled to both circuitry 804 and solenoid valve 901; the latter enabling an easy solution for a kit in which several components may be offered to a user for retrofitting a food waste disposer into a disposer in accordance with the present invention.

As mentioned above, in exemplary embodiments, circuitry 804 may be configured with different programmable routines. For example, and without limiting the scope of the present invention, shutting off the food waste disposer and closing the solenoid valve may occur simultaneously. Alternatively, shutting off the food waste disposer and closing the solenoid valve may occur within a programmable delay so that one occurs after the other. Similarly, activating motor 802 and opening solenoid valve 901 may be programmed so that the two actions are simultaneous or within a programmable delay so that one occurs after the other.

In exemplary embodiments, these routines may be pre-programmed into the memory of circuitry 804 and may not be re-programmed by an end-user, such as a typical consumer. In other exemplary embodiments, circuitry 804 may be more complex and allow for end-user programming. For example, in one embodiment, circuitry 804 may include a transceiver for communicating with an external device, such as a mobile phone, and can be programmed via a mobile application accessible to an end-user including a technician or consumer.

An automatic shut-off food waste disposer system has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A food waste disposer system, comprising:

a light-emitting diode (LED) indicator configured to indicate a status of the food waste disposer;

a solenoid valve for selectively directing a water flow from a water supply to a disposer chamber of a food waste disposer;

a sensor coupled to a motor of the food waste disposer, the sensor configured to detect a revolutions per minute (RPM) or torque load value of the motor; and a control circuitry for supplying power to the food waste disposer and the solenoid valve, the control circuitry configured to:

activate the food waste disposer responsive to a user input;

open the solenoid valve to direct the water flow from the water supply to the disposer chamber of the food waste disposer;

receive the RPM or torque load value from the sensor;

adjust the LED indicator in response to the RPM or torque load value detected by the sensor to indicate the status of the food waste disposer; and automatically shut off the food waste disposer and close the solenoid valve when the sensor detects a programmable RPM or torque load value.

2. The food waste disposer system of claim 1, wherein automatically shutting off the food waste disposer and closing the solenoid valve occur simultaneously.

3. The food waste disposer system of claim 1, wherein shutting off the food waste disposer and closing the solenoid valve occur within a programmable delay.

4. The food waste disposer system of claim 1, further comprising an enclosure for housing the solenoid valve, the enclosure including one or more mounting structures.

5. The food waste disposer system of claim 1, wherein adjusting the LED indicator in response to the RPM or torque load value comprises changing the color of the LED indicator.

6. The food waste disposer system of claim 1, further comprising a pneumatic actuator in fluid communication with the control circuitry configured to receive the user input.

7. The food waste disposer system of claim 1, further comprising a communications module configured to transmit the user input to the control circuitry.

8. The food waste disposer system of claim 7, wherein the communications module communicates with the control circuitry through Bluetooth™ technology or Wi-Fi™ technology.

9. A food waste disposer system, comprising:

a display configured to indicate a status of the food waste disposer;

a pneumatic actuator configured to direct air through a tube, wherein the pneumatic actuator is located adjacent to a sink;

a solenoid valve for selectively directing a water flow from a water supply to a disposer chamber of a food waste disposer;

a sensor coupled to a motor of the food waste disposer, the sensor configured to detect a revolutions per minute (RPM) or torque load value of the motor; and a control circuitry in communication with the pneumatic actuator for supplying power to the food waste disposer and the solenoid valve, the control circuitry configured to:

activate the food waste disposer responsive to a user actuating the pneumatic actuator;

open the solenoid valve to direct the water flow from the water supply to the disposer chamber of the food waste disposer;

receive the RPM or torque load value from the sensor;

adjust the display in response to the RPM or torque load value detected by the sensor to indicate the status of the food waste disposer; and automatically shut off the food waste disposer and close the solenoid valve when the sensor detects a programmable RPM or torque load value.

10. The food waste disposer system of claim 9, wherein automatically shutting off the food waste disposer and closing the solenoid valve occur simultaneously.

11. The food waste disposer system of claim 9, wherein shutting off the food waste disposer and closing the solenoid valve occur within a programmable delay.

12. The food waste disposer system of claim 9, wherein adjusting the display in response to the RPM or torque load value comprises changing the color of the display.

* * * * *